US005820165A

United States Patent [19]

Verenski

[11] Patent Number: 5,820,165

[45] Date of Patent: Oct. 13, 1998

[54] FOLDING CARTON WITH ATTACHMENT AND COVER

[75] Inventor: Gregory Verenski, Lake Villa, Ill.

[73] Assignee: Nosco, Inc., Gurnee, Ill.

[21] Appl. No.: 613,191

[22] Filed: Mar. 8, 1996

[51] Int. Cl.[6] ..... B42D 15/00

[52] U.S. Cl. ..... 283/62; 283/56; 283/63.1

[58] Field of Search ..... 281/2, 5, 51, 38; 283/61, 62, 117, 56, 63.1

[56] References Cited

U.S. PATENT DOCUMENTS

| | | | |
|---|---|---|---|
| Re. 30,958 | 6/1982 | White . | |
| 752,463 | 2/1904 | Morris | 40/312 X |
| 2,790,587 | 4/1957 | Contant | 40/312 X |
| 4,010,299 | 3/1977 | Hershey, Jr. et al. . | |
| 4,606,553 | 8/1986 | Nickerson . | |
| 5,351,991 | 10/1994 | McDonald . | |

*Primary Examiner*—Willmon Fridie, Jr.
*Attorney, Agent, or Firm*—Patula & Associates

[57] ABSTRACT

A folding carton or box is provided with a detachable panel preferably in the form of a business reply card. An informational brochure or pamphlet is suitably secured between the outside front panel of the box and the detachable panel or business reply card. The detachable panel is folded over the informational material and the open end of the detachable panel is secured down to the box by seals. To gain access to the information an end user need simply to break the seals. The detachable panel or business reply card can then be simply removed from the box and returned to the manufacturer or company.

25 Claims, 8 Drawing Sheets

FOLDING CARTON WITH ATTACHMENT AND COVER

The present invention relates to folding cartons and in particular boxes. Specifically the present invention relates to a folding carton that has attached informational material such as a brochure or pamphlet thereto and includes a detachable cover for the informational material in the form of an information card, such as a business reply card.

BACKGROUND OF THE INVENTION

It is known in the art to attached an outsert to the outside of a container, for example, a medicine bottle. An outsert is a folded piece of paper containing printed information or instructions regarding a product or the content of the container to which the outsert is affixed. Typical outserts are folded numerous times into a compact package which is then shrink wrapped to the side of the container, such as illustrated in FIG. 6 of the U.S. Pat. No. 5,458,374 issued to Vijuk, et al. on Oct. 17, 1995. Other known outserts are folded and attached to the side of a bottle through adhesive such as illustrated in U.S. Pat. No. 5,351,991 issued to McDonald on Oct. 4, 1994.

However, while these folded outserts are suitable for attachment to the sides of containers such as medicine bottles, items which are shipped and are sold in boxes obviate the need for attaching such outserts to the container since informational material may simply be inserted into the carton or box in which the product is shipped and is sold. However, there is a disadvantage to inserting printed sheet material into boxes. For example, pharmaceutical companies supply doctors, who in turn supply patients with medicine samples in a box. Instructions printed on sheet material are also inserted into the box. However, the pharmaceutical companies often have to place the printed information into the boxes by hand resulting in a time-consuming process. Further, doctors and/or patients who received these boxes containing the medicine samples often do not take the time to read the instructions because they are difficult to remove from the carton. Additionally, many companies and manufacturers wish to include business reply cards inside boxes. However, all to often, these cards are never seen or hard to extract from the box and thus intentionally overlooked and discarded with the box.

Accordingly, there is a need for an efficient, time-saving package design that is easy for users to readily access the printed information pertaining to the product therein and/or the company or manufacturer, and further that is easy to use, can be readily accessed, and is time efficient to manufacture. The present invention solves the problems related to inserting printed information into boxes by providing a folding carton with an attached informational booklet, brochure, pamphlet or the like to the outside of the box and including a business reply card which is detachable from the outside of the box and is used to cover and protect the informational brochures.

BRIEF SUMMARY OF THE INVENTION

The present invention comprises a folding carton having a detachable panel extending therefrom once the carton is folded into a box. Informational sheet material, preferably in the form of a brochure or pamphlet is suitably attached to the outside of the box. The detachable panel then is used as a cover for the attached outsert by suitably fastening the open end of the detachable panel to the box to secure and protect the attached informational brochure. Preferably the detachable panel is in the form of a business reply card.

The present invention is particularly suitable for advertising and promotional needs wherein a sample product or promotional item is placed within the box and the informational brochure of the particular item and/or company making the item is attached according to the present invention. Further the company's business reply card is detachable therefrom allowing a user to quickly send for additional information and/or place an order.

Accordingly, it is the principle object of the present invention to provide a means for providing an informational brochure to the outside of a folding carton or box.

It is a further object of the present invention to provide printed informational material to the outside of a folding carton and further provide a detachable panel therefrom.

It is also an object of the present invention to provide printed informational material which can be readily accessed from the outside of a box and including a business reply card.

It is an additional object of the present invention to teach a box having a brochure attached to the outside thereof and securely fastened to the box and protected from ripping or tearing by securely fastening down with a business reply card.

Numerous other advantages and features of the invention will become readily apparent from the detailed description of the preferred embodiment of the invention, from the claims, and from the accompanying and drawings in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figure 1A:
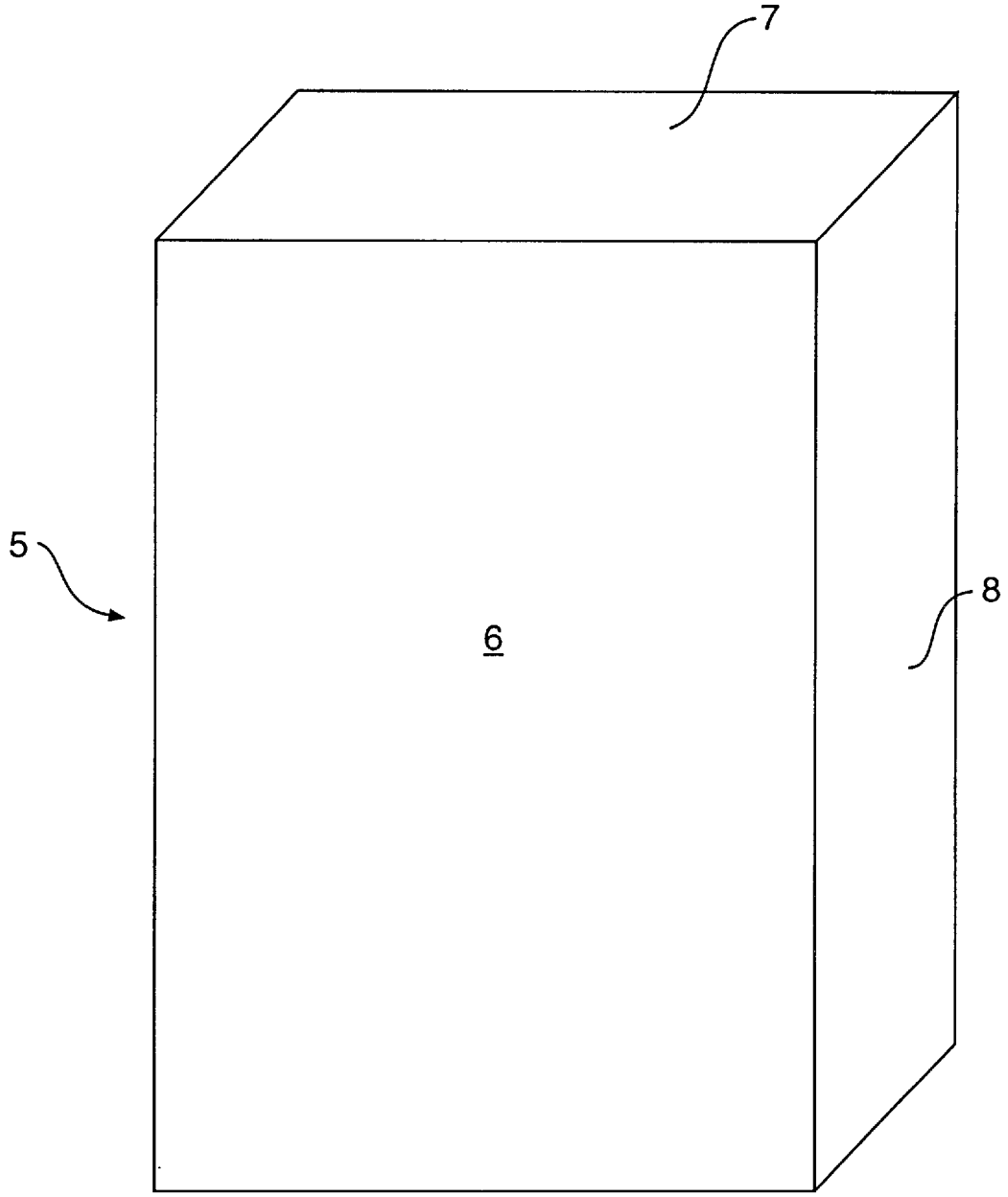
FIG. 1A (PRIOR ART)
FIG. 1(A) is a front perspective view of a prior art folding container or box.

While the invention is susceptible of embodiment in many different forms, there is shown in the drawings and will be described herein in detail preferred embodiments of the invention. It should be understood however, that the present disclosure is to be considered an exemplification of the principles of the invention and is not intended to limit the spirit and scope of the invention and/or claims of the embodiment illustrated.

Figure 1B:
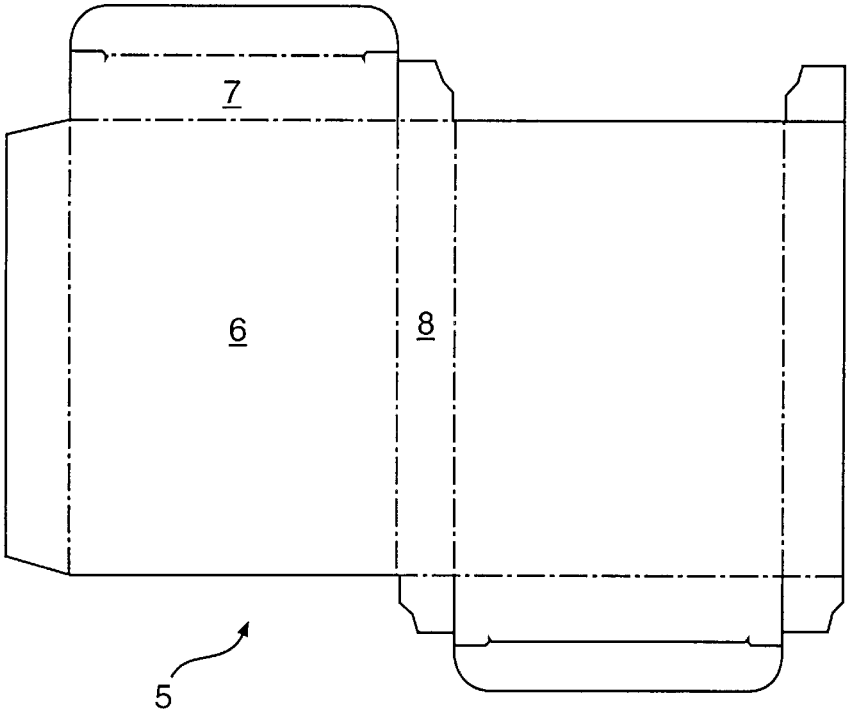
FIG. 1B (PRIOR ART)
FIG. 1(B) is a front view of a prior art container in an unfolded position.

FIGS. 1(A) and 1(B) illustrate a prior art folding carton or box in which a product and informational material is inserted therein. Prior art box 5 can be seen as having a front panel 6, top panel 7, and a side panel 8 in FIG. 1(A). In FIG. 1(B), prior art box 5 is shown in an unfolded position and including front panel 6, top panel 7, and side panel 8.

Figure 2:
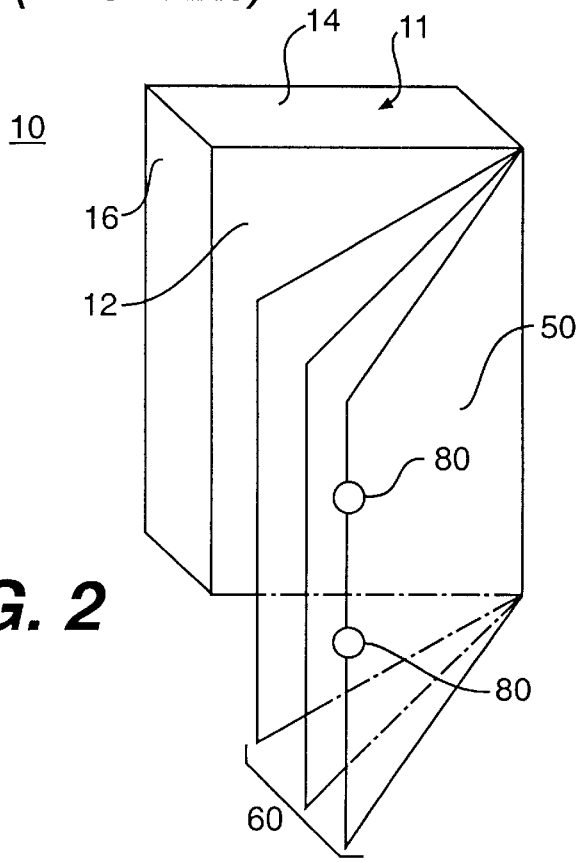
FIG. 2 is a perspective view of the present invention in a folded position.

FIG. 2 illustrates the present invention 10 comprising three main portions, a folding container or box 11, a detachable panel 50 and printed informational sheet material 60. Box 11 can be seen as having a front panel 12, a top panel 14, and a side panel 16. Detachable panel 50 can be seen attached at one side of front panel 12 and informational sheet material 60 can be seen positioned between front panel 12 and detachable panel 50. Detachable panel 50 further includes means for releasably securing panel 50 to box 11 illustrated as sealing tabs or wafer seals 80 to seal the open end of detachable panel 50 against the box, thereby enclosing printed informational sheet material 60 thereto. Seals 80 could be any suitable fasteners such as adhesive applied to the inside edge of panel 50 which would then be secured to box 11 upon contact with front panel 12. If using adhesive, sheet material 60 must be smaller in size than front cover 12 so as not to interfere with the adhesive contacting the front cover 12. Detachable panel 50 is preferably in form of a business reply card such that a user may simply detach panel 50 and return the same to the company and/or manufacturer of the product therein. However, panel 50 can be manufactured as not being detachable so as to serve solely as a cover.

Figure 3:
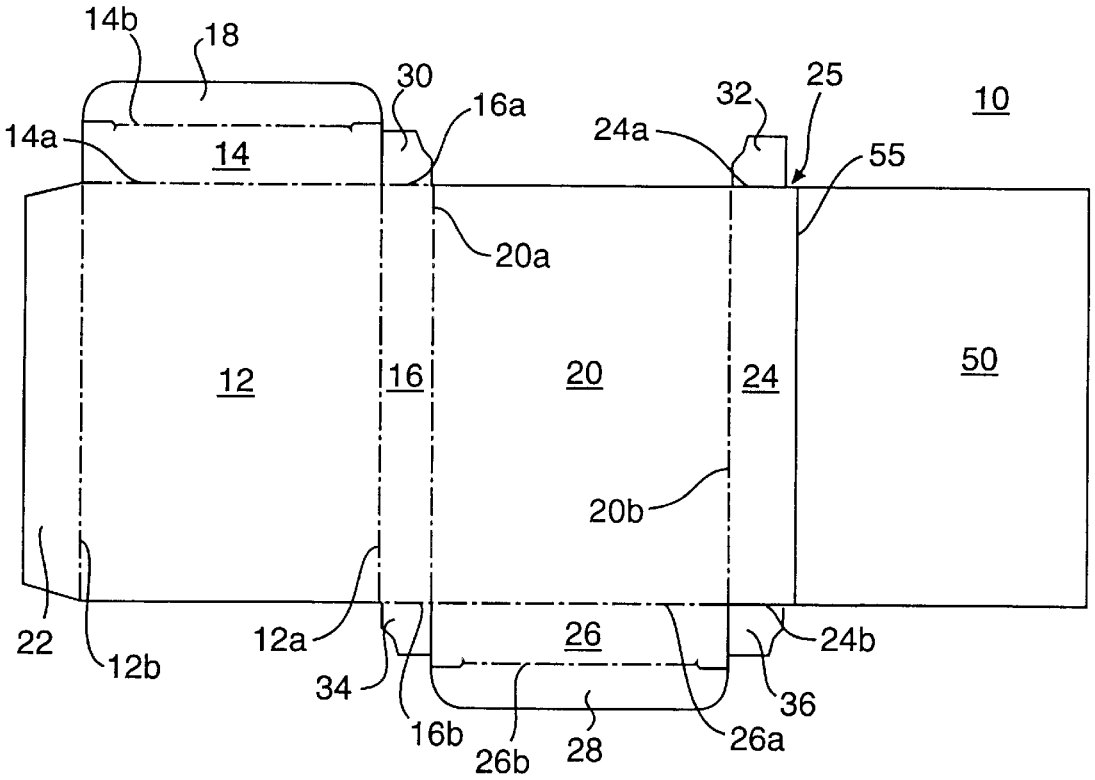
FIG. 3 is a front view of the present invention in an unfolded position.
Figure 4:
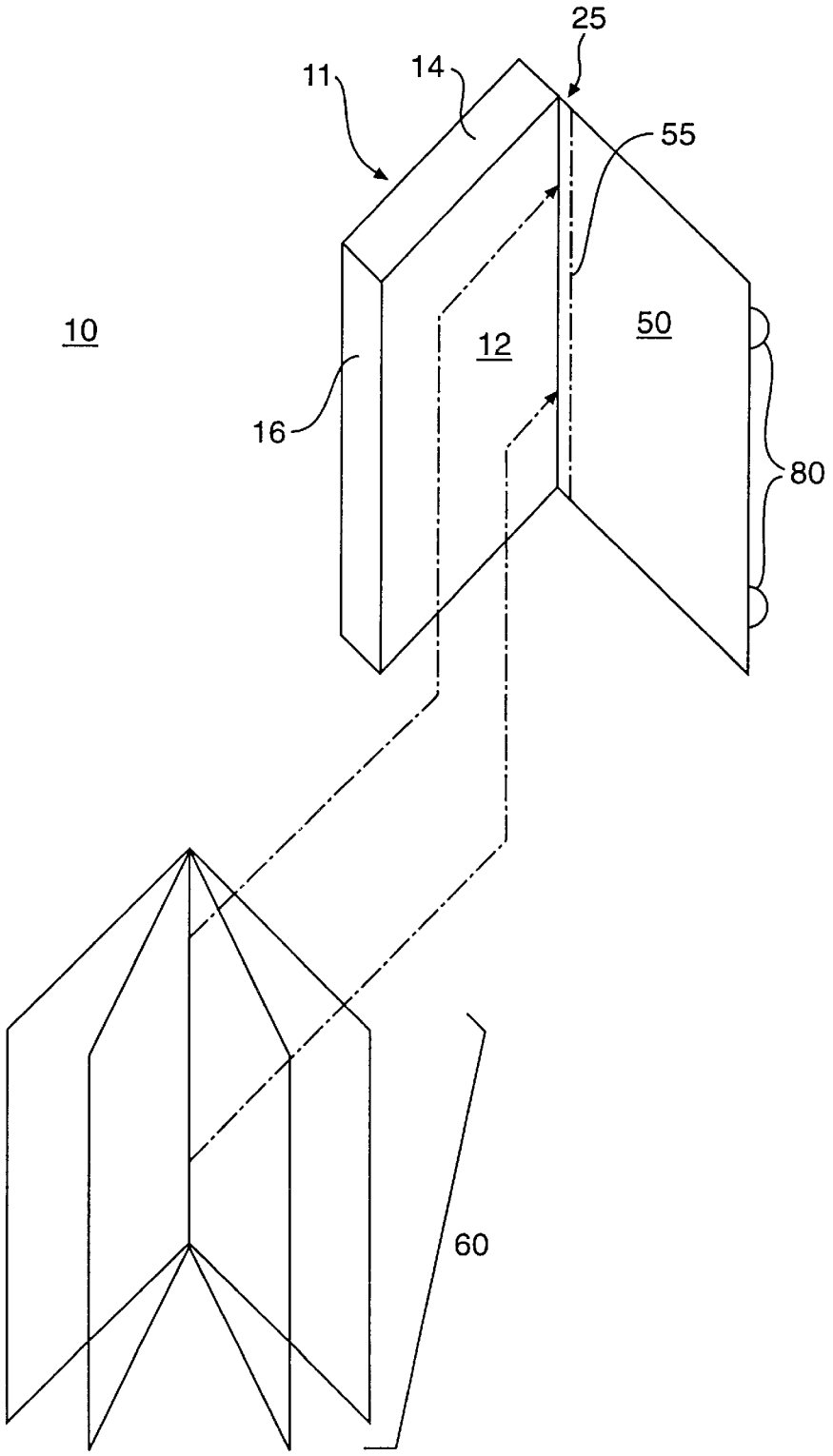
FIG. 4 is an exploded perspective view of the present invention in a folded position.

FIG. 3 illustrates the front view of the carton or box 11 with detachable panel 50 in an unfolded position. As can be seen, box 11 comprises a front panel 12, a back panel 20, a top panel 14, a bottom panel 26 and side panels 16 and 24. Side panel 24 is preferably constructed such that its width is slightly wider than side panel 16 thereby forming a short side extension 25 upon folding carton or box 11 into its carton or box shape, as can be seen in FIG. 4. Attached to the extended portion 25 of side panel 24 is the detachable panel 50. Preferably detachable panel 50 is attached to side panel 24 at extension 25 through a perforated or scored fold line 55 to allow for ease of removal.

Box 11 further has a top panel 14 and a bottom panel 26. Attached to top panel 14 is a top flap 18 and attached to bottom panel 26 is a bottom flap 28. Further attached to front panel 12 is an interior side connector flap 22 which, when carton or box 11 is folded, is suitably attached to side panel 24 to form the carton or box 11. Box 11 also includes top side panel flaps 30 and 32, and bottom side panel flaps 34 and 36.

To form the carton or box 11, front panel 12 is folded along front panel fold 12*a*. Back panel 20 is folded along first back panel fold 20*a* and second back panel fold 20*b*. Interior side flap connector 22 is folded along second front panel fold 12*b* and is brought into juxta-position with side panel 24 and suitably attached thereto such as by an adhesive. Top side panel flaps 30 and 32, and bottom side panel flaps 34 and 36 are folded along first side panel flap folds 16*a* and 24*a*, and second side panel folds 16*b*, 24*b* respectively. Bottom panel 26 is folded along first bottom panel fold 26*a* and bottom flap 28 is folded along second bottom panel fold 26*b* and is inserted into the box. Top panel 14 is folded along first top panel fold 14*a* and top flap 18 is folded along second top panel fold 14*b* and inserted into the box. The folded carton thus forms box 11 having detachable panel 50 extending therefrom.

As can be better seen in FIG. 4, detachable panel 50 is attached to the extended portion 25 of side panel 24 of box 11 which includes front panel 12, top panel 14 and side panel 16. Informational sheet material 60 is illustrated in FIG. 4 as a multi-sheet informational brochure or pamphlet positioned between front panel 12 and detachable panel 50 of the present invention 10 and is suitably fastened thereto, for example by the means illustrated in FIGS. 5 and 6.

Figure 5:
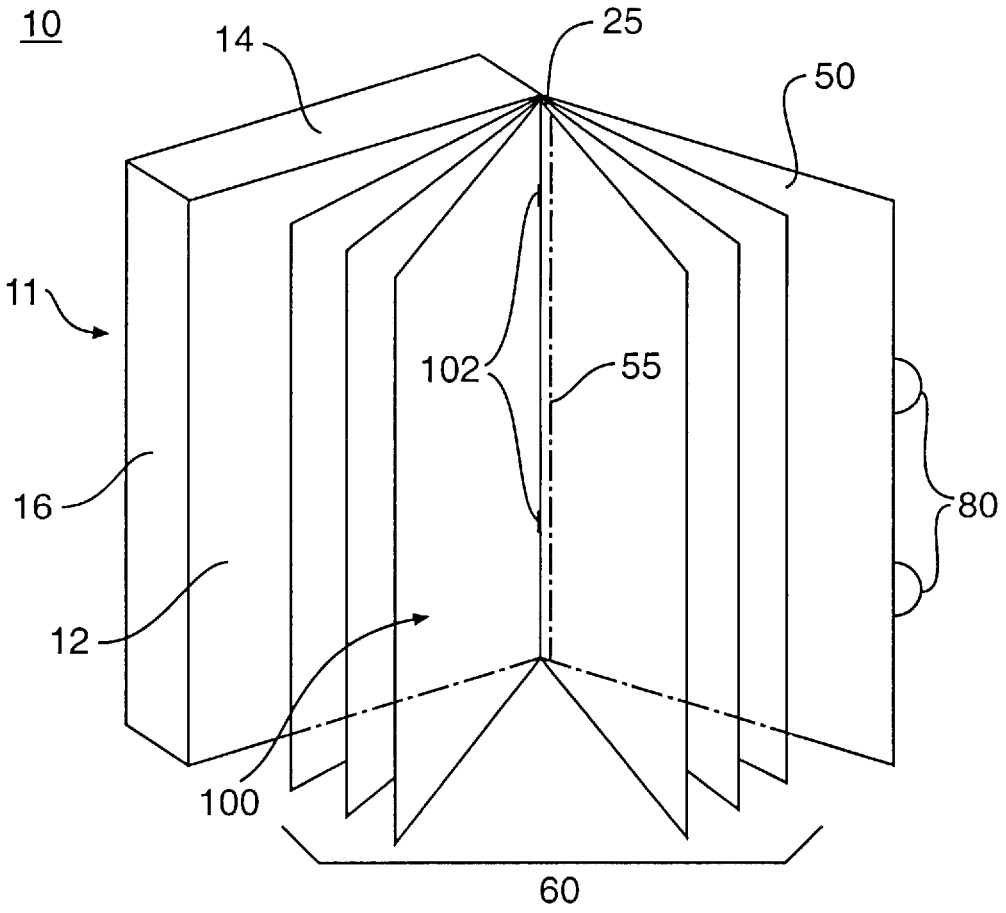
FIG. 5 is a perspective view of the present invention illustrating one embodiment of the brochure fastening means.

As can be seen in FIG. 5, the present invention 10 includes folding carton or box 11 having front panel 12, top panel 14 and side panel 16. Extension 25 extends a small distance away from front panel 12 and includes a detachable panel 50 attached thereto. The distance extension 25 extends preferably corresponds to the thickness of sheet material 60. In any event, extension 25 should extend a sufficient distance to allow panel 50 to cover sheet material 60 and be secured down. Informational sheet material 60 is positioned between front panel 12 of box 11 and the detachable panel 50 and is suitably attached thereto by fastening means 100 illustrated in FIG. 5 as staples 102. Further shown attached to the detachable panel 50 are tabs or wafer seals 80 such that detachable panel 50 may be folded over the informational sheet material 60 and secured to box 11 upon wafer seals 80 being secured to side panel 16 of box 11.

Figure 6:
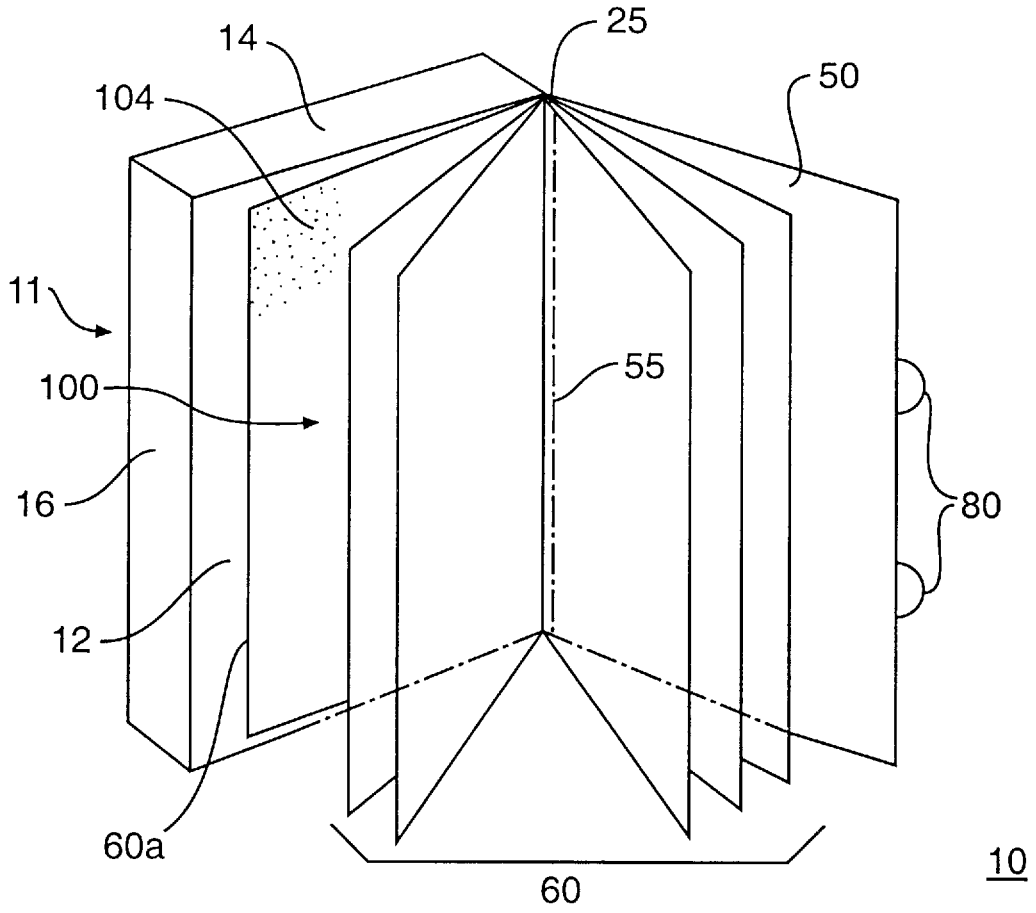
FIG. 6 is a perspective view of the present invention illustrating an alternate embodiment of the brochure fastening means.

Alternatively as shown is FIG. 6, information sheet material 60 may be attached to front panel 12 wherein the end sheet 60*a* of sheet material 60 is attached directly to front panel 12 of box 11 by fastening means 100 illustrated as adhesive or glue 104. Detachable panel 50 is then folded over sheet material 60 and attached to box 11 via wafer seals 80 as previously described. It should be understood that sheet material 60 could be suitably attached by other methods such as gluing the spine of sheet material 60 to extension 25.

In use, an unfolded box 11 with extension panel 50 as illustrated in FIG. 3 is provided and is folded as described into the folded box 11 as illustrated in FIG. 4. Informational sheet material 60 is then positioned between the front panel 12 and detachable panel 50 as illustrated in FIGS. 5 and 6. Detachable panel 50 is then secured to box 11 by wafer seals 80. The completed box 11 with informational sheet material 60 and detachable panel 50 secured thereto is then sent to an end user. The end user simply need only to remove or break wafer seals 80 from side panel 16 of box 11 to gain access to the informational sheet material 60. Then if so desired the end user can simply detach panel 50 along perforated fold line 55 from box 11 and send panel 50, in the form of a business reply card, back to the company and/or manufacturer to receive more information, place an order, etc.

Figure 7:
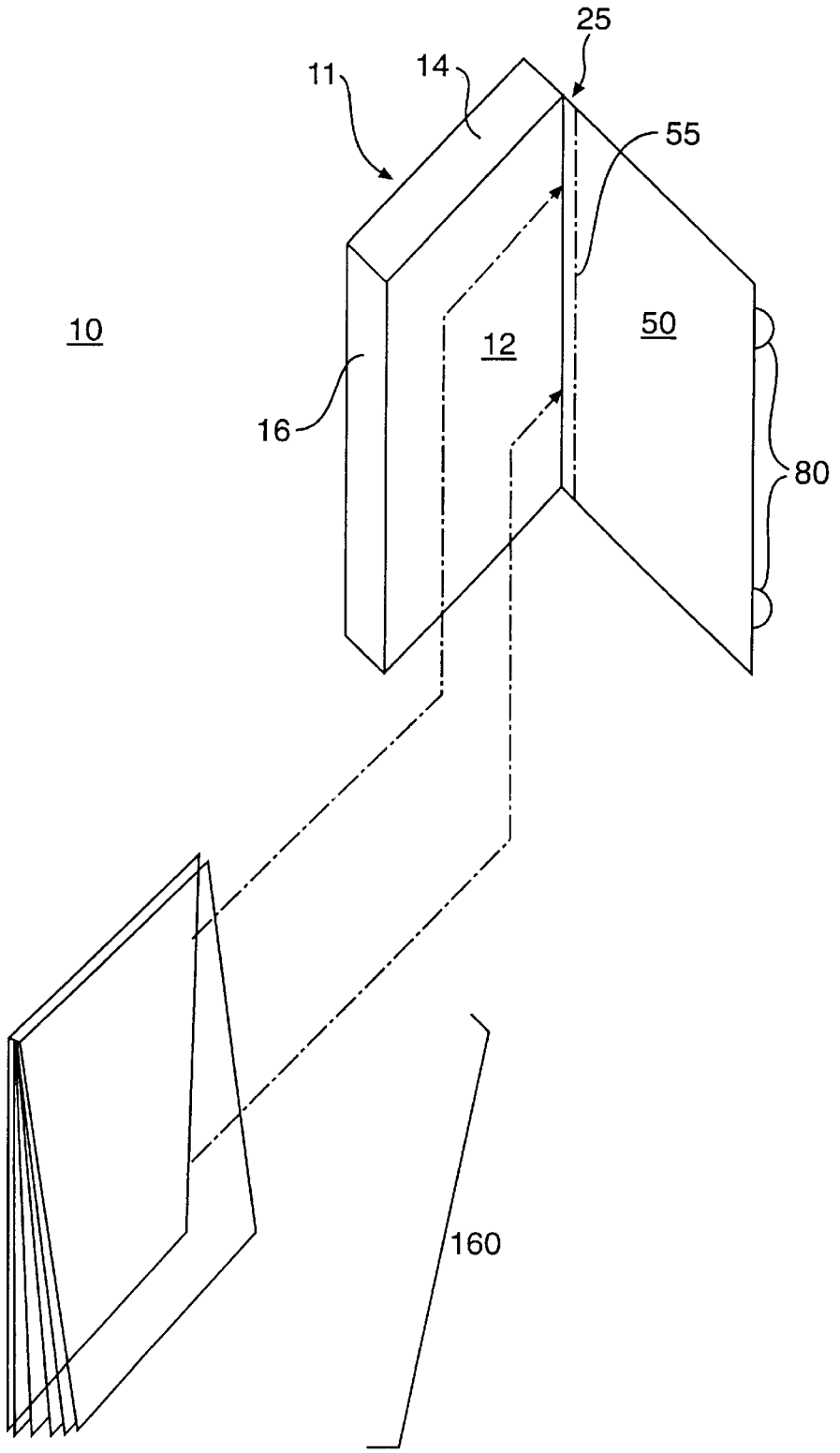
FIG. 7 is an exploded perspective view of the present invention illustrating an alternate embodiment of the informational sheet material.

FIG. 7 illustrates, in an alternate embodiment, informational sheet material in the form of a pad 160 which is suitably attached between front cover 12 and panel 50 as described above in regard to FIG. 6. In this embodiment, pad 160 may comprise a plurality of individual instruction sheets or the like. Thus, a user such as a doctor can tear off the top sheet and hand it out along with, for example, a sample drug contained in box 11. It should be understood that pad 160 can be suitably attached between front panel 12 and panel 50 in any manner. For example, pad 160 could be bound along a longitudinal edge which is then glued to extension 25.

Figure 8:
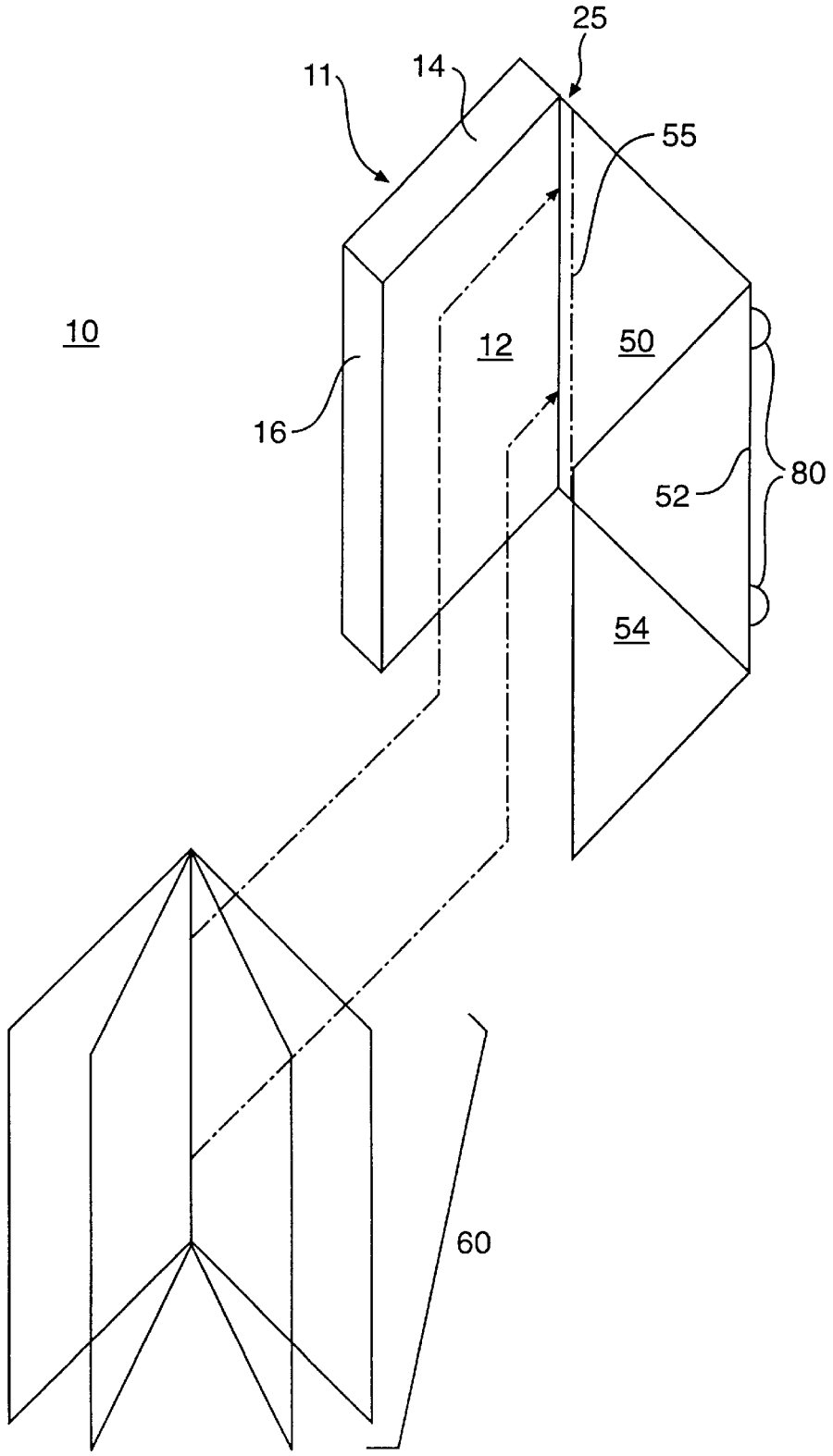
FIG. 8 is an exploded perspective view of an alternate embodiment of the present invention having a second additional panel.

FIG. 8 illustrates an alternate embodiment of the present invention which is identical in all respects as the embodiment illustrated in FIGS. 1–6 above, with the exception that an additional panel 54 is attached to the outer edge 52 of panel 50, through a perforated or scored fold line. In this embodiment, both panel 50 and 54 could be detachable and in the form of a business reply card or the like. Alternatively, panel 50 could be non-detachable and serve solely as a cover and panel 54 could be detachable.

In use, panel 54 would be folded along line 52 until it is in juxtaposition with panel 50. Panel 50 is then folded along line 55 to cover sheet material 60 such that panel 54 is in juxtaposition with sheet material 60. Seals 80 then attach to box 11. A user then need only remove the seals 80 and unfold panels 50 and 54 to gain access to sheet material 60. Panel 54 can be detached (as well as cover 50 as desired).

It is foreseen that any number of additional panels can be attached sequentially to provide an end user a plurality of business reply cards or the like. It is also foreseen that sheet material 60 (or 160) could be suitably attached to panel 50 as well, in which case panel 54 would fold around sheet material 60 before sealing panel 50 to box 11.

It is to be understood that the embodiments as herein described are merely illustrative of the principles of the present invention. Various modifications may be made by those skilled in the art without departing from the spirit or scope of the claims which follow. For example, detachable panel 50 could be suitably attached along any edge of box 11 by any suitable means. Likewise, sheet material 60 can be attached to the outside of box 11 in any suitable manner and can be folded or unfolded as desired. Pad 160 could be comprised of instruction sheets, product literature, coupons, etc. Further, it is foreseen that panel 50 and panel 54 could both be attached directly to box 11 along opposite sides, or an attachment and cover could be provided on both sides of the box.

What is claimed is:

1. A folding carton comprising:

a plurality of panels forming said carton and defining an exterior and an interior;

at least one panel extending from and attached to said exterior of said carton; and sheet material suitably attached to one of said at least one panel and said exterior of said carton;

said carton having a first position wherein said at least one panel is juxtapositioned with at least one of said plurality of panels forming said carton, with said sheet material enclosed therebetween; and said carton having a second position wherein said at least one panel is spaced away from said carton, with said sheet material freely accessible.

2. The folding carton of claim 1, wherein said at least one panel is detachable from said exterior of said carton.

3. The folding carton of claim 1, wherein said sheet material is an informational brochure.

4. The folding carton of claim 1, wherein said sheet material is attached to said carton by means for fastening.

5. The folding carton of claim 1, wherein said at least one panel has a free edge and an attachment edge, said at least one panel being attached to said exterior of said carton along said attachment edge and defining a hinge, said at least one panel being pivotable about said hinge and selectively enclosing said sheet material between said exterior of said carton and said at least one panel upon said free edge being secured to said exterior of said carton by means for securing.

6. An attachment for a folding carton having a plurality of panels forming an interior and an exterior, said attachment comprising:

at least one cover panel attached to said exterior of said folding carton and being selectively removable therefrom; and sheet material suitably fastened to one of said at least one cover panel and said exterior of said folding carton, said sheet material being enclosed between said exterior of said carton and said at least one cover panel upon said at least one cover panel being juxtapositioned with one of said plurality of panels forming said carton, said sheet material being freely accessible upon said at least one cover panel being spaced away from said exterior of said carton.

7. The attachment of claim 6, wherein said at least one cover panel is a business reply card.

8. The attachment of claim 6, wherein said sheet material is an informational brochure.

9. The attachment of claim 6, further comprising means for securing said at least one cover panel to said exterior of said carton with said sheet material therebetween.

10. An attachment for a folding carton having a front panel and a back panel each defining a plane, and a first side panel and a second side panel, said attachment comprising:

an extended panel portion on at least one of said first side panel and said second side panel, said extended panel portion extending past the plane of one of said front panel and back panel;

at least one cover panel having an attachment edge and being selectively removably attached to said extended panel portion along said attachment edge and forming a hinge therealong, said at least one cover panel selectively pivotable towards and away from said folding carton about said hinge; and sheet material suitably attached to one of said at least one cover panel, said front panel, and said back panel;

said sheet material being enclosed between said at least one cover panel and one of said front panel and said back panel upon said at least one cover panel being pivoted to overlie said one of said front panel and said back panel.

11. The attachment of claim 10, wherein said at least one cover panel is a business reply card.

12. The attachment of claim 10, wherein said sheet material contains printed information.

13. An attachment for a box having a front panel and a side panel and defining an exterior and a selectively enclosed interior, said attachment comprising:

at least one cover panel attached to said exterior of said box; and at least one sheet material insert suitably fastened to one of said front panel and said at least one panel extending from said box;

said sheet material being enclosed between said at least one cover panel and said exterior of said box when said at least one cover panel is in a first closed position in planar juxtaposition with said front panel of said box;

said sheet material being freely accessible when said at least one cover panel is in a second open position at least partially spaced away from said exterior of said box.

14. The attachment of claim 13, wherein said at least one cover panel includes means for securing said at least one cover panel to said box in said first closed position.

15. The attachment of claim 15, wherein said at least one cover panel includes a first panel and a second panel attached to said first panel along a fold line.

16. The attachment of claim 17, wherein said second panel is selectively detachable from said first panel along said fold line.

17. The attachment of claim 13, wherein said at least one insert is a pamphlet.

18. The attachment of claim 13, wherein said at least one insert is a pad of sheet material.

19. The attachment of claim 18, wherein said sheet material is selectively detachable from said pad.

20. A media presentation device for a box defining an interior and an exterior in an assembled position, said media presentation device comprising;

a cover element attached to said exterior of said box, said cover element including at least one panel and being selectively positionable about at least one hinged edge; and a media item selectively secured to said exterior of said box via said cover element, said cover element substantially entirely enclosing said media item such that said media item is substantially entirely unexposed until said cover element is selectively positioned about said hinged edge.

21. A folding carton comprising:

a plurality of panels forming said carton and defining an exterior and an interior;

at least one panel extending from and attached to said exterior of said carton; and media material suitably attached to one of said at least one panel and said exterior of said carton;

said carton having a first position wherein said at least one panel is juxtapositioned with at least one of said plurality of panels forming said carton, with said media material enclosed therebetween; and said carton having a second position wherein said at least one panel is spaced away from said carton, with said media material freely accessible.

22. The folding carton of claim 21, wherein said at least one panel is detachable from said exterior of said carton.

23. The folding carton of claim 21, wherein said media material is attached to said carton by means for fastening.

24. The folding carton of claim 21, wherein said at least one panel has a free edge and an attachment edge, said at least one panel being attached to said exterior of said carton along said attachment edge and defining a hinge, said at least one panel being pivotable about said hinge and selectively enclosing said media material between said exterior of said carton and said at least one panel upon said free edge being secured to said exterior of said carton by means for securing.

25. An attachment for a folding carton having a front panel and a back panel each defining a plane, and a first side panel and a second side panel, said attachment comprising:

an extended panel portion on at least one of said first side panel and said second side panel, said extended panel portion extending past the plane of one of said front panel and back panel;

at least one cover having an attachment edge and being selectively removably attached to said extended panel portion along said attachment edge and forming a hinge therealong, said at least one cover selectively pivotable towards and away from said folding carton about said hinge; and a media device suitably attached to one of said at least one cover, said front panel, and said back panel;

said media device being enclosed between said at least one cover and one of said front panel and said back panel upon said at least one cover being pivoted to overlie said one of said front panel and said back panel.

* * * * *

UNITED STATES PATENT AND TRADEMARK OFFICE

CERTIFICATE OF CORRECTION

PATENT NO : 5,820,165

DATED : Oct. 13, 1998

INVENTOR(S) : Verenski

It is certified that error appears in the above-identified patent and that said Letters Patent is hereby corrected as shown below:

In claim 15, (column 6, line 58), the phrase "claim 15" should read --claim 13--;

In claim 16, (column 6, line 61), the phrase "claim 17" should read --claim 15--.

Signed and Sealed this

Twelfth Day of January, 1999

*Attest:*

*Attesting Officer*

*Acting Commissioner of Patents and Trademarks*